US008782813B2

(12) United States Patent
Usami

(10) Patent No.: US 8,782,813 B2
(45) Date of Patent: Jul. 22, 2014

(54) INTEGRATED WAIST SUSPENSION SYSTEM

(75) Inventor: Hidetoshi Usami, Tokyo (JP)

(73) Assignee: Columbia Sportswear North America, Inc., Portland, OR (US)

( * ) Notice: Subject to any disclaimer, the term of this patent is extended or adjusted under 35 U.S.C. 154(b) by 0 days.

(21) Appl. No.: 13/218,343

(22) Filed: Aug. 25, 2011

(65) Prior Publication Data

US 2012/0073026 A1 Mar. 29, 2012

Related U.S. Application Data

(60) Provisional application No. 61/377,062, filed on Aug. 25, 2010.

(51) Int. Cl.
*A41D 1/02* (2006.01)

(52) U.S. Cl.
USPC ..... 2/96; 2/108

(58) Field of Classification Search
USPC ..... 2/85, 86, 87, 88, 89, 90, 91, 92, 93, 94, 2/95, 96, 97, 102, 108, 311, 309, 321, 2/322, 336, 338, 339, 340, 2.15
See application file for complete search history.

(56) References Cited

U.S. PATENT DOCUMENTS

| | | | | | |
|---|---|---|---|---|---|
| 265,536 | A | * | 10/1882 | Oberst | 2/84 |
| 866,342 | A | * | 9/1907 | Demacakos | 2/95 |
| 1,214,893 | A | * | 2/1917 | Butler | 2/85 |
| 1,243,828 | A | * | 10/1917 | Freedman | 2/102 |
| 1,254,043 | A | * | 1/1918 | James | 450/31 |
| 1,271,047 | A | * | 7/1918 | McQuarrie | 2/95 |
| 1,304,382 | A | * | 5/1919 | Schiller | 2/95 |
| 1,915,597 | A | * | 6/1933 | Ducker | 2/95 |
| 1,931,331 | A | * | 10/1933 | Staw | 2/95 |
| 2,069,579 | A | * | 2/1937 | Epstein | 2/95 |
| 2,127,763 | A | * | 8/1938 | Bentz | 2/85 |
| 2,229,593 | A | * | 1/1941 | Russo | 2/102 |
| 2,292,348 | A | * | 8/1942 | Bailey | 2/97 |
| 2,321,768 | A | * | 6/1943 | Osth | 2/95 |

(Continued)

FOREIGN PATENT DOCUMENTS

| | | |
|---|---|---|
| DE | 19920499 | 9/2001 |
| DE | 102004006395 | 8/2005 |

(Continued)

*Primary Examiner* — Alissa L Hoey
(74) *Attorney, Agent, or Firm* — Schwabe, Williamson & Wyatt, P.C.

(57) ABSTRACT

Embodiments herein are directed to outerwear garments having an integrated suspension system that allows a user to carry the garment around the user's waist when the garment is not needed. One or more straps are provided that may be coupled to an interior surface of the outerwear. A single strap may extend around the body of the user, or, alternatively, multiple straps may be provided that are coupled to the outerwear and which may be coupled to each other to secure the straps. In various embodiments, the ends of the one or more straps may be coupled to one another to form a waist belt for attaching the outerwear about the waist of the user when the garment is not being worn. When the outerwear is no longer needed, for instance because of changing weather conditions or body temperature, the user may simply remove the outerwear and attach the garment around his or her waist using the waist belt suspension system, for instance by coupling two ends of the one or more straps, thus forming a belt around the waist of the user.

11 Claims, 3 Drawing Sheets

(56) References Cited

U.S. PATENT DOCUMENTS

| | | | | | |
|---|---|---|---|---|---|
| 2,391,352 | A | * | 12/1945 | Schwartz | 2/93 |
| 2,443,447 | A | * | 6/1948 | Falcon | 2/93 |
| 2,472,141 | A | * | 6/1949 | Botha | 2/86 |
| 2,549,592 | A | * | 4/1951 | Ganz | 2/96 |
| 2,582,772 | A | * | 1/1952 | Egbert | 2/95 |
| 2,620,479 | A | * | 12/1952 | Buck | 2/94 |
| 3,105,241 | A | * | 10/1963 | Allen | 2/94 |
| 3,147,491 | A | * | 9/1964 | Fisch | 2/86 |
| 3,606,613 | A | * | 9/1971 | Johnson, Jr. | 2/96 |
| 3,973,643 | A | * | 8/1976 | Hutchinson | 182/3 |
| 4,057,854 | A | | 11/1977 | Phelps | |
| 4,344,620 | A | * | 8/1982 | Debski | 482/105 |
| 4,663,781 | A | * | 5/1987 | Krosby | 2/86 |
| 4,731,882 | A | * | 3/1988 | Ekman | 2/69 |
| 4,797,954 | A | * | 1/1989 | Williams et al. | 2/106 |
| 5,267,352 | A | * | 12/1993 | Rodarmel | 2/44 |
| 5,301,371 | A | * | 4/1994 | Chao | 2/102 |
| 5,450,627 | A | * | 9/1995 | Grilliot et al. | 2/81 |
| 5,452,476 | A | * | 9/1995 | Jenks | 2/46 |
| 5,575,011 | A | * | 11/1996 | Allen | 2/227 |
| 5,611,084 | A | * | 3/1997 | Garry et al. | 2/93 |
| 5,694,643 | A | * | 12/1997 | Fujiwara | 2/69 |
| 5,813,051 | A | * | 9/1998 | Counter | 2/69 |
| 5,909,802 | A | * | 6/1999 | Puco et al. | 2/102 |
| 5,946,724 | A | * | 9/1999 | Erickson | 2/93 |
| 5,946,726 | A | * | 9/1999 | Green | 2/109 |
| 5,970,517 | A | * | 10/1999 | Jordan | 2/69 |
| 5,970,520 | A | * | 10/1999 | Garofalo | 2/102 |
| 6,128,782 | A | * | 10/2000 | Young et al. | 2/69 |
| 6,131,199 | A | * | 10/2000 | Bugel et al. | 2/102 |
| 6,138,277 | A | * | 10/2000 | Gillen et al. | 2/102 |
| 6,233,740 | B1 | * | 5/2001 | Meyers et al. | 2/102 |
| 6,305,024 | B1 | * | 10/2001 | Schweer | 2/94 |
| 6,405,378 | B1 | * | 6/2002 | Garner | 2/102 |
| 6,421,834 | B2 | * | 7/2002 | Kester | 2/94 |
| 6,637,547 | B1 | * | 10/2003 | Wydner | 182/3 |
| 6,658,666 | B2 | * | 12/2003 | Schweer | 2/94 |
| 6,698,026 | B2 | * | 3/2004 | Schweer | 2/94 |
| 6,708,343 | B1 | * | 3/2004 | Ceron | 2/88 |
| 6,722,544 | B1 | * | 4/2004 | Stephens et al. | 224/659 |
| 6,859,942 | B1 | * | 3/2005 | Cratty | 2/88 |
| 6,892,395 | B2 | * | 5/2005 | Schweer | 2/94 |
| 7,000,255 | B1 | * | 2/2006 | Baacke | 2/94 |
| 7,047,567 | B2 | * | 5/2006 | Allen | 2/69 |
| 7,165,271 | B2 | * | 1/2007 | Elen | 2/85 |
| 7,343,629 | B2 | * | 3/2008 | Hunt | 2/93 |
| 7,779,484 | B2 | * | 8/2010 | Fee et al. | 2/69 |
| 7,836,519 | B2 | * | 11/2010 | Zahler | 2/69 |
| 7,985,144 | B1 | * | 7/2011 | Gonzales | 473/212 |
| 8,001,618 | B2 | * | 8/2011 | Bay | 2/93 |
| 8,091,151 | B2 | * | 1/2012 | Johnson et al. | 2/455 |
| 8,403,724 | B1 | * | 3/2013 | Chapin | 450/32 |
| 2003/0014804 | A1 | | 1/2003 | Morales | |
| 2004/0163156 | A1 | * | 8/2004 | Schweer | 2/69 |
| 2004/0199976 | A1 | * | 10/2004 | Hunt | 2/93 |
| 2004/0221362 | A1 | * | 11/2004 | Bosne et al. | 2/93 |
| 2006/0059601 | A1 | * | 3/2006 | Opitz et al. | 2/108 |
| 2006/0162041 | A1 | * | 7/2006 | Tengbom et al. | 2/85 |
| 2006/0218690 | A1 | | 10/2006 | James | |
| 2007/0017001 | A1 | * | 1/2007 | Wagner et al. | 2/102 |
| 2008/0276344 | A1 | * | 11/2008 | Woolcott et al. | 2/87 |
| 2009/0241235 | A1 | * | 10/2009 | Weinreb | 2/84 |
| 2010/0031413 | A1 | * | 2/2010 | Jensen | 2/69.5 |
| 2010/0043118 | A2 | * | 2/2010 | Woolcott et al. | 2/87 |
| 2010/0127025 | A1 | | 5/2010 | Kelling | |
| 2010/0320241 | A1 | * | 12/2010 | Thompson | 224/153 |
| 2011/0030119 | A1 | * | 2/2011 | Fee et al. | 2/93 |
| 2011/0041234 | A1 | * | 2/2011 | Blackford | 2/97 |

FOREIGN PATENT DOCUMENTS

| | | |
|---|---|---|
| JP | 2000-226706 | 8/2000 |
| JP | 2003003303 | 1/2003 |
| JP | 2007-230557 | 9/2007 |

* cited by examiner

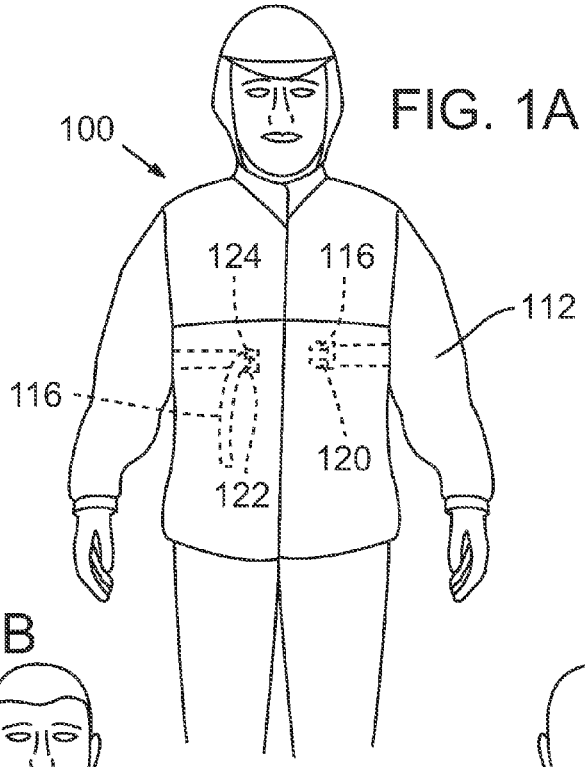
FIG. 1A
FIG. 1B
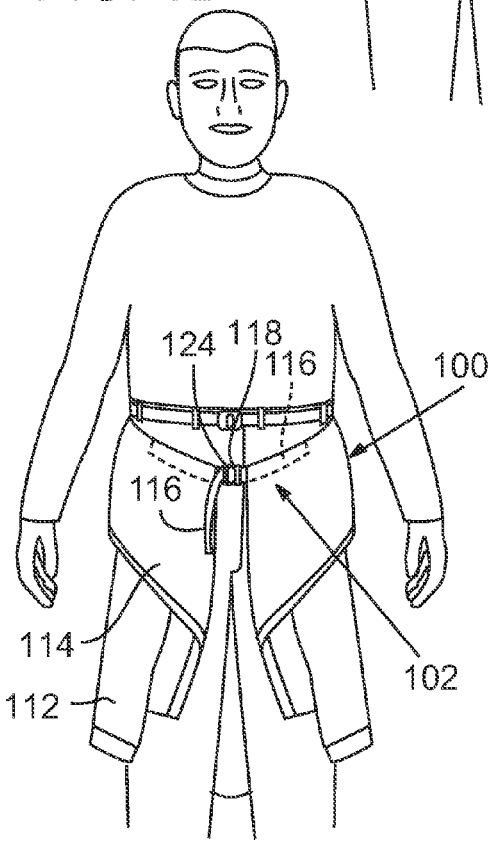
FIG. 1C
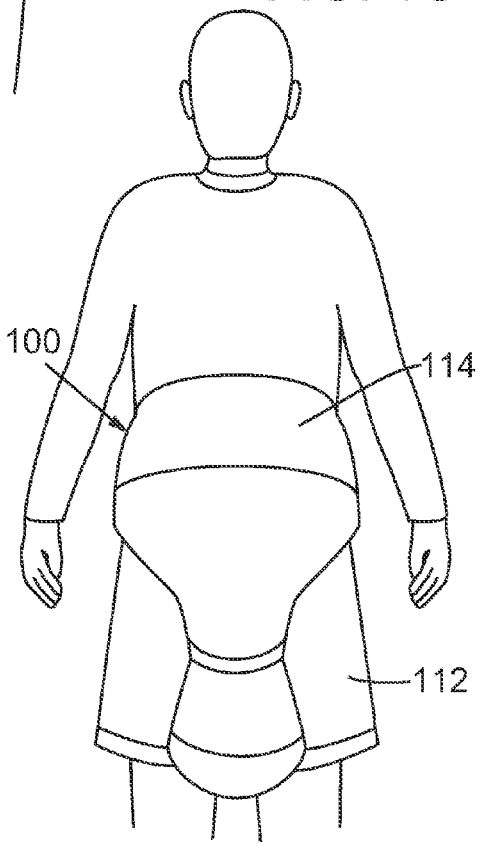

INTEGRATED WAIST SUSPENSION SYSTEM

CROSS REFERENCE TO RELATED APPLICATIONS

The present application claims priority to U.S. Provisional Patent Application No. 61/377,062, filed Aug. 25, 2010, entitled "Integrated Waist Suspension System," the entire disclosure of which is hereby incorporated by reference in its entirety.

TECHNICAL FIELD

Embodiments herein relate generally to the field of outerwear, and more particularly to a suspension system for use with outerwear, such as jackets and coats, and even more particularly, to systems that help facilitate drying wet outwear while still coupled to a user's body.

BACKGROUND

Outerwear such as raincoats, parkas, windbreakers, and performance outerwear frequently becomes wet during use in rain and snow. Additionally, it is common for outerwear users to remove outerwear during use, for instance as the outside temperature rises, as body heat rises due to exertion, and/or as inclement weather passes and rain gear and other protective clothing is no longer needed, but such users may want to keep the outerwear nearby. Carrying unneeded outerwear can be cumbersome, particularly when both hands are needed for activities, or when the outerwear is wet.

A common strategy for dealing with unneeded outerwear is for a user to tie the sleeves of the garment around their waist. However, this is not a secure means of carrying the garment, and it may become loose or fall off, particularly during activity. Additionally, tying a wet garment around the waist can cause the user's clothing to become wet, and the garment may not dry properly, particularly in the portions wrapped tightly around the body (e.g., the arms).

BRIEF DESCRIPTION OF THE DRAWINGS

Embodiments herein will be readily understood by the following detailed description in conjunction with the accompanying drawings. Embodiments are illustrated by way of example and not by way of limitation in the figures of the accompanying drawings.

FIGS. 1A, 1B, and 1C illustrate different views of an example of a jacket with an integrated waist suspension system during use, including a front view of the jacket being worn (FIG. 1A), and a front view (FIG. 1B) and back view (FIG. 1C) of the jacket suspended by the integrated waist suspension system, in accordance with various embodiments.

DETAILED DESCRIPTION OF EMBODIMENTS

Figure 2A:
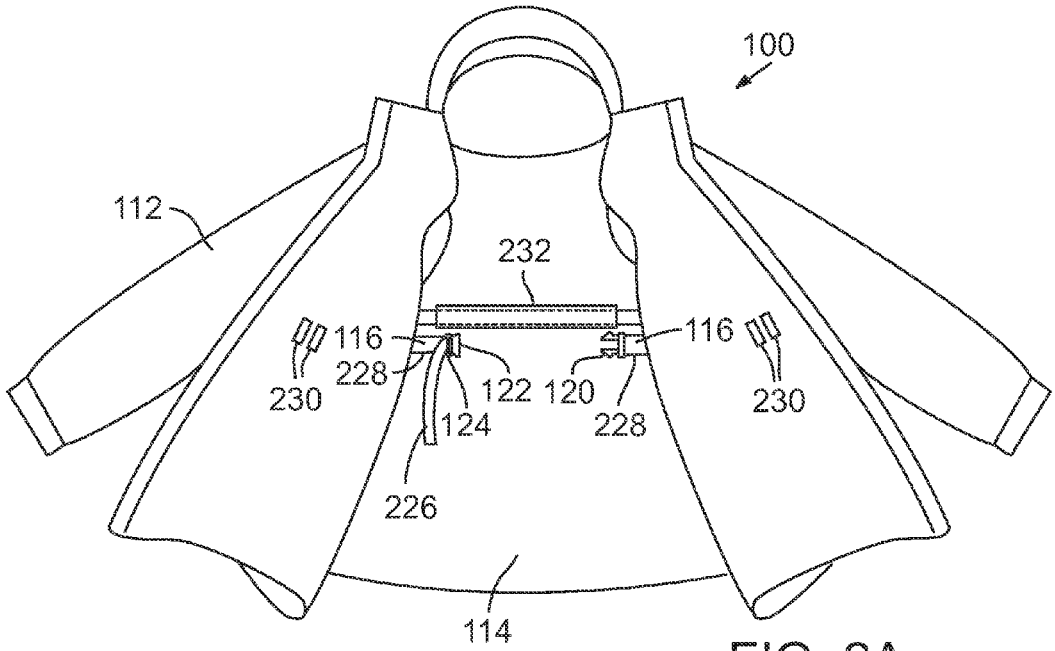
FIGS. 2A, 2B, 2C, and 2D illustrate various views of examples of integrated waist belt suspension systems, in accordance with various embodiments.

In the following detailed description, reference is made to the accompanying drawings which form a part hereof, and in which are shown by way of illustration of embodiments in which the disclosure may be practiced. It is to be understood that other embodiments may be utilized and structural or logical changes may be made without departing from the scope of the present disclosure. Therefore, the following detailed description is not to be taken in a limiting sense, and the scopes of embodiments, in accordance with the present disclosure, are defined by the appended claims and their equivalents.

Various operations may be described as multiple discrete operations in turn, in a manner that may be helpful in understanding embodiments of the present disclosure; however, the order of description should not be construed to imply that these operations are order-dependent.

The description may use perspective-based descriptions such as up/down, back/front, and top/bottom. Such descriptions are merely used to facilitate the discussion and are not intended to restrict the application of embodiments herein.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

Embodiments herein are directed to outerwear garments having an integrated suspension system that allows a user to carry the garment around the user's waist when the garment is not needed. The system is particularly useful when the outerwear has become wet, for instance from use in inclement weather conditions, because it allows the garment to air-dry while still coupled to the user's body. In particular embodiments, the integrated waist suspension system of the present disclosure may allow the user to easily carry the outerwear with the outer surface of the garment oriented generally away from the body of the user (or at least generally not in contact with the user's body or other clothing), which protects the user from moisture, while also allowing air to circulate over and around the garment, which may facilitate air-drying.

The term "waist" is used throughout this description to describe a location on a user's body where outerwear may be suspended using the integrated suspension system. The term "waist" should be construed broadly to include the waist, hip, or generally the midsection of the user, as particular user anatomy, comfort, or style may dictate a slightly different orientation of the suspended outerwear. As used herein, the terms "suspension" or "suspended" or the like refer to positioning outerwear to hang from the body of a user without the user's arms and shoulders supporting the outerwear in a normally worn arrangement. For example, outerwear is "suspended" from a user when an interior waist belt is used to hang outerwear from a user's waist while the outerwear is not covering the user's arms or shoulders, etc.

In various embodiments, one or more straps are provided that may be coupled to an interior surface of the outerwear. A single strap may extend around the body of the user, or, alternatively, multiple straps may be provided that are coupled to the outerwear and which may be coupled to each other to secure the straps. In various embodiments, the ends of the one or more straps may be coupled to one another to form a waist belt for attaching the outerwear about the waist of the user when the garment is not being worn. When the outerwear is no longer needed, for instance because of changing weather conditions or body temperature, the user may simply remove the outerwear and attach the garment around his or her waist using the waist belt suspension system, for instance by coupling two ends of the one or more straps, thus forming a belt around the waist of the user. In various embodiments, this may allow the outerwear to hang behind the user's back and/or legs with the outer surface of the outerwear facing away from the user's body, and/or with two portions of the outer surface of the outerwear folded over and facing each other. The outerwear may be better positioned to dry, while also keeping the outerwear secure and out of the way of the user.

The one or more straps may be made from any material, but it is preferable that the straps are suitably strong and lightweight, for instance nylon or polyester webbing or a foam, such as ethylene vinyl acetate (EVA). In some embodiments, the one or more straps may be made from a breathable material, such as nylon or polyester mesh, cotton, linen, bamboo, hemp, or other natural material. In other embodiments, the material may be elastic or have an elastic component, such as Spandex™, Lycra™, or rubber, for instance to provide comfort to the user. In some embodiments, the elastic component may be an elastic insert in the strap material, such that only a portion of the one or more straps is elastic.

FIGS. 1A-1C show several views of an example of a jacket 100 with an integrated waist suspension system 102 in accordance with various embodiments. The illustrated jacket 100 has an exterior surface 112 and an interior surface 114, and in various embodiments interior surface 114 may have coupled thereto one or more straps 116 that may be fastened around the waist of a user. In various embodiments, multiple straps may be used, and all or a portion of the straps may be accessible, typically through the front opening of the garment. Straps 116 may include a fastening device 118, such as a clip, buckle, snap, hook, button, tie, hook and loop fastener such as Velcro™, etc. FIG. 1A illustrates an embodiment with a clip having male and female ends 120, 122, which are complementary fastening components of fastening device 118 and which may be coupled to one another to form a belt generally encircling the waist of the user. Fastening device 118 also may include an adjustment member 124, for instance, a slide or buckle that may be used to adjust straps 116 to adjust the belt length (circumference) to fit the body of the user.

Strap(s) 116 may couple to outerwear in a variety of ways, such as shown in FIGS. 2A-2D. FIG. 2A illustrates an embodiment in which strap 116 passes through a channel 232 in the back of jacket interior 114, leaving, for instance, two free ends 228 of strap 116. A channel 232 may be formed directly in the jacket interior 114 or a separate element, such as a separate strip of material, may be coupled to interior 114 to form channel 232. In some embodiments, free ends 228 of strap 116 may be coupled to or coupled within interior 114 when not in use with a retaining member, such as snaps, hooks, buttons, hook and loop fasteners, or retaining pockets, loops, or fasteners of any kind. Example retaining members 230 are illustrated in FIG. 2A, in which free ends 228 may be inserted to secure free ends 228 in a desired position when strap 116 is not in use. As such, a free end 228 of strap 116 may be reversibly coupled to interior 114 of the outerwear. When needed, free end 228 of strap 116 may be decoupled from interior 114, such as by disengaging a snap, Velcro™, etc. to facilitate use of strap 116.

Figure 2B:
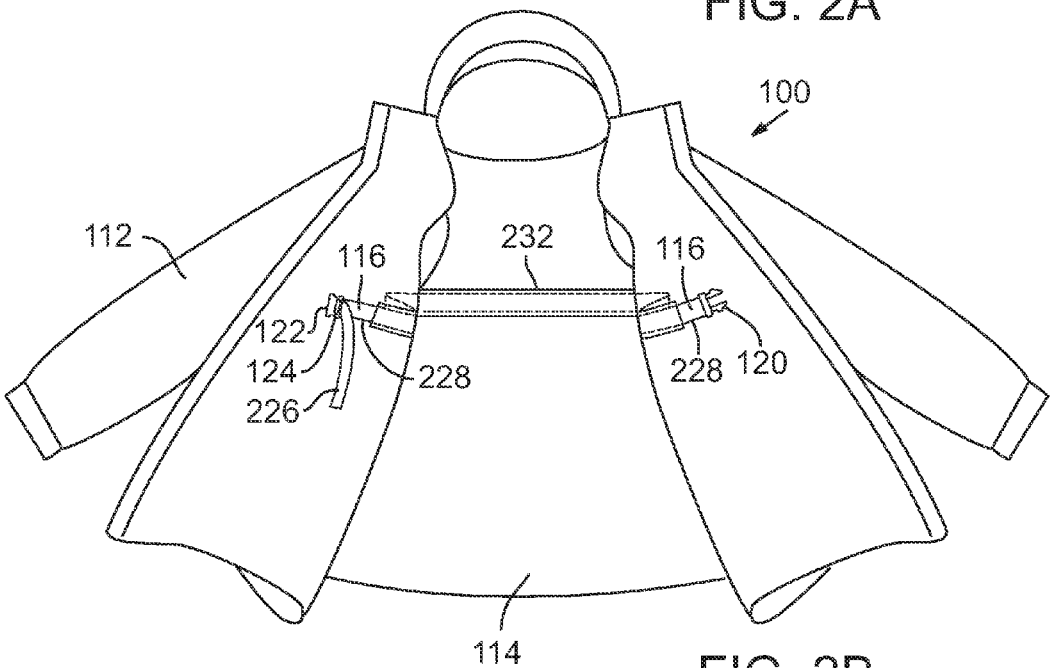

In an alternate embodiment shown in FIG. 2B, channel 232 may be long enough to enclose most of strap 116, leaving just a short portion of free ends 228 uncovered. In embodiments such as shown in FIGS. 2A and 2B, strap 116 may be removable from the outerwear to be cleaned or if the provided function is not desired.

Figure 2C:
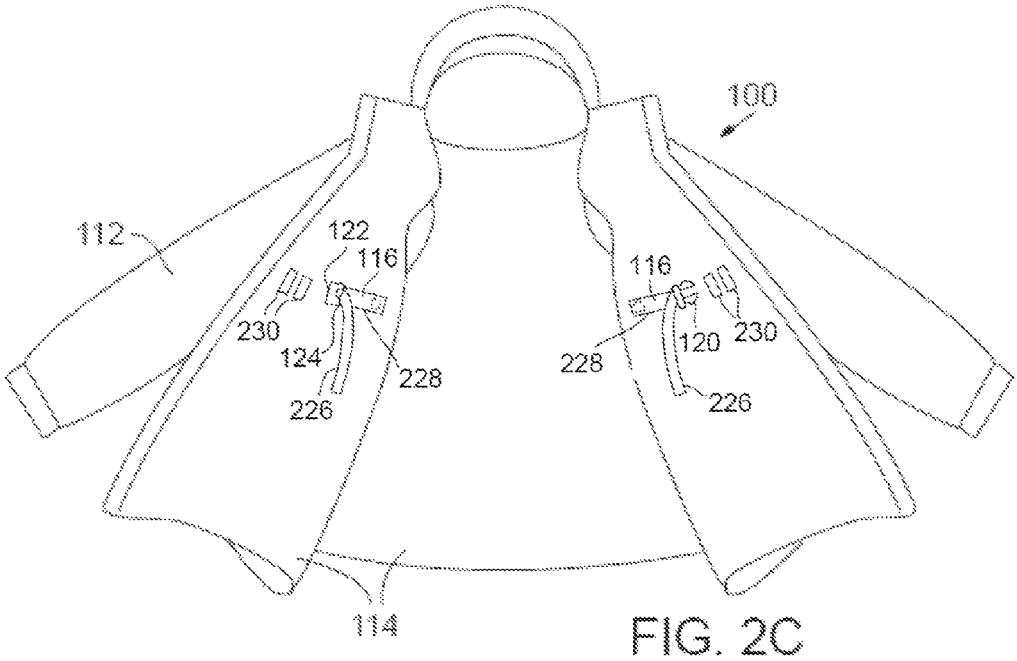
Figure 2D:
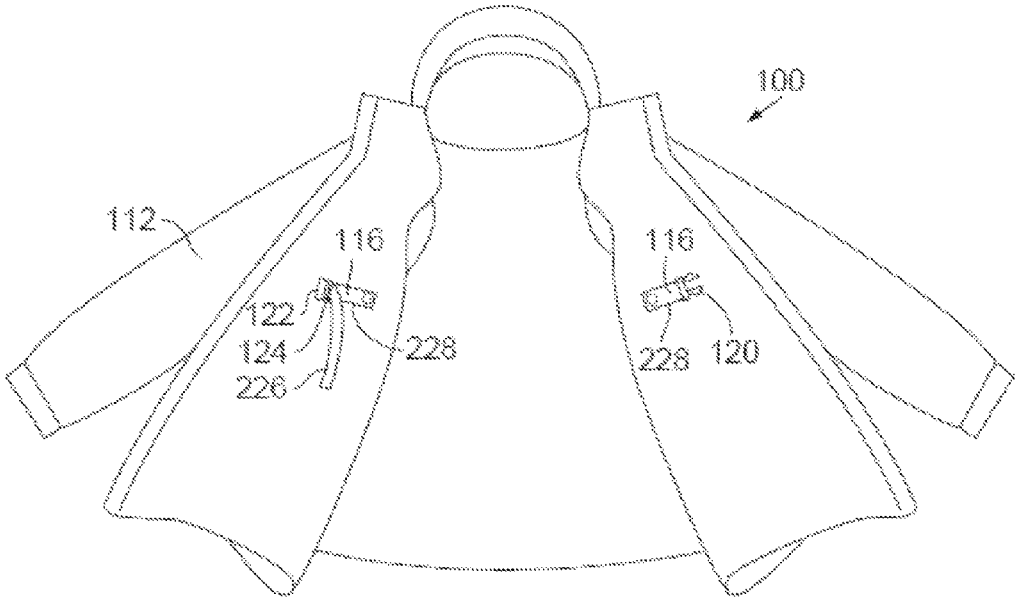

FIG. 2C illustrates another embodiment that lacks channel 232. Instead, two individual short straps 116 are coupled to the jacket interior 114, for instance on the interior front side of the jacket. The two straps 116 are coupled to opposing front sides of interior 114 of the outerwear. The phrase "opposing front sides" refers to the left and right front sides of the outerwear. If a front opening is present, the front opening is generally between the opposing front sides of the outerwear. As shown, the two straps collectively do not extend around the user's body when the two free ends are coupled together. Adjustable ends 226 denote the sides of the straps 116 that may be adjusted. FIG. 2D illustrates yet another alternate embodiment, wherein straps 116 are included, but only one side is adjustable (noted as adjustable end 226).

In some embodiments, one or both of free ends 228 of strap(s) 116 may be adjusted, for instance with one or more adjustment members 124, such as buckles, slides, ladder hooks, etc. Such adjustability may serve to make the waist belt adaptable to a wide range of waist sizes and carrying preferences.

In various embodiments, the position of the strap(s) within the outerwear may be higher or lower than illustrated. For instance, in some embodiments it may be desirable to position the strap(s) approximately mid-way between the waist and the shoulder region of the jacket. This position may have the advantage of allowing a greater portion of the outside surface of the outerwear to remain exposed to air circulation when the waist suspension system is used, which may speed drying (if needed). Conversely, in other embodiments, it may be desirable to position the strap(s) approximately mid-way between the waist and the hip region of the jacket. This position has the advantage of allowing the jacket to fold on itself, which may keep the jacket out of the way of the legs of the user, particularly when the user is of shorter stature.

Although the integrated waist suspension systems illustrated herein show the straps positioned horizontally along the waist, in some embodiments one or more straps may be positioned substantially diagonally across the outerwear, which would allow the outerwear to be carried in a messenger bag type configuration. In this embodiment, when the suspension system is in use, the strap may be fastened diagonally across the body of the user (e.g., over one shoulder). Not only does this position the outerwear higher on the body, which keeps it out of the way of the user's legs, but it also secures the outerwear during vigorous activities. In various other embodiments, one or more straps may be disposed in a more vertical orientation such that the user could wear the jacket in a backpack strap type configuration and allow the outerwear to drape off the back portion of the wearer.

In various embodiments, a strap may be comprise one or more layers of padding, for instance Techlite™ EVA padding, which may be included to increase the comfort of a user. In some embodiments, the one or more padding layers may include one or more apertures or cutouts that create ventilation areas, for instance to enhance breathability, moisture vapor transfer, and/or heat transfer through the strap and away from the user's body. In some embodiments, these ventilation areas may also serve to reduce the weight of the strap, which also may increase the comfort of the user. In various embodiments, the strap also may include one or more binding layers, such as a mesh material.

In addition, while one strap or set of straps is illustrated, in embodiments, multiple straps or sets of straps may be provided to vary/expand the suspension options.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

The invention claimed is:

1. An outerwear suspension system, comprising:

a garment of outerwear having:

an upper portion, a lower portion, a waist portion between the upper and lower portions, a front opening defined by right and left opening edges, a right front panel horizontally bordered by the right opening edge, a left front panel horizontally bordered by the left opening edge, a rear portion disposed between the right and left front panels, a left armhole in the upper portion and between the left front panel and the rear portion, a right armhole in the upper portion between the right front panel and the rear portion, an interior surface extending from the right opening edge, across the right front panel, rear portion and left front panel, and to the left opening edge, and an exterior surface extending from the right opening edge, across the right front panel, rear portion and left front panel, and to the left opening edge, wherein:

the right and left front panels are separable by the front opening, the interior and exterior surfaces face away from each other and meet at the left opening edge and at the right opening edge, and the upper portion is configured to engage a user's shoulders while the outerwear is worn by the user in a first configuration;

a suspension element consisting of left and right straps, the left strap coupled to the interior surface of the left front panel at a left attachment location located in the waist portion and spaced away from the left opening edge, and the right strap coupled to the interior surface of the right front panel at a right attachment location located in the waist portion and spaced away from the right opening edge;

a left retaining member, located on the interior surface of the left front panel and spaced away from the left attachment location, wherein the left retaining member is complementary to a left coupling component disposed on a free end of the left strap; and a right retaining member, located on the interior surface of the right front panel and spaced away from the right attachment location, wherein the right retaining member is complementary to a right coupling component disposed on a free end of the right strap;

wherein:

the left coupling component and the right coupling component are further complementary to each other, and while the outerwear is worn by the user in a second configuration in which the upper portion is disengaged from the user's shoulders, the upper portion hangs downwardly from the suspension element.

2. The system of claim 1, further comprising a strap length adjustment member located on at least one of the left or right straps.

3. The system of claim 2, wherein the strap length adjustment member comprises a slide or buckle.

4. The system of claim 1, wherein the right and left coupling components comprise snaps, buttons, clips, buckles, hooks, ties, or hook and loop fasteners.

5. The system of claim 1, wherein at least one of the left and right straps comprises an elastic material.

6. An outerwear suspension system, comprising:

a garment of outerwear having:

right and left front panels separable by a front opening defined by right and left edges, a rear portion disposed between the right and left front panels, an interior surface extending from the right opening edge, across the right front panel, rear portion and left front panel, and to the left opening edge, an exterior surface extending from the right opening edge, across the right front panel, rear portion and left front panel, and to the left opening edge, upper portion, a lower portion, a waist portion between the upper and lower portions, and left and right armholes in the upper portion, wherein the interior and exterior surfaces face away from each other and meet at the left opening edge and at the right opening edge;

a left strap coupled to the interior surface in the waist portion on the left front panel at a left attachment point spaced away from the left opening edge, the left strap having a free end extending away from the left attachment point and having a left coupling component disposed on the free end of the left strap; and a right strap coupled to the interior surface in the waist portion on the right front panel at a right attachment point spaced away from the right opening edge, the right strap having a free end extending away from the right attachment and having a right coupling component disposed on the free end of the right strap;

a left retaining member, coupled to the interior surface in the waist portion on the left front panel and spaced away from the left attachment point, wherein the left retaining member is complementary to the left coupling component; and a right retaining member, coupled to the interior surface in the waist portion on the right front panel and spaced away from the right attachment point, wherein the right retaining member is complementary to the right coupling component;

wherein the left and right coupling components are further complementary to each other.

7. The system of claim 6, wherein the left and right straps are disposed entirely within an interior of the garment when the front opening is closed.

8. The system of claim 6, wherein the lower portion is bounded by a bottom edge, and wherein the left and right straps are positioned closer to the left and right armholes, respectively, than to the bottom edge.

9. The system of claim 6, wherein at least one of the left or right straps comprises an adjustment member to adjust a length of the left or right strap between the left or right attachment point and the left or right free end, respectively.

10. The system of claim 9, wherein the adjustment member comprises a slide or buckle.

11. The system of claim 6, wherein at least one of the left and right straps comprises an elastic material.

* * * * *